US007121401B1

(12) United States Patent
Sinha et al.

(10) Patent No.: US 7,121,401 B1
(45) **Date of Patent: *Oct. 17, 2006**

(54) PACKAGING SYSTEM FOR AMMUNITION

(75) Inventors: Yash Sinha, Trenton, NJ (US); Mark Benko, Greeneville, TN (US); Ronald Dale Turner, Chuckey, TN (US); Philip Kadlecek, Wilmington, DE (US); Yuen H. Lam, Morris Plains, NJ (US); William C. Paulo, Parsippany, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 395 days.

This patent is subject to a terminal disclaimer.

(21) Appl. No.: 10/707,168

(22) Filed: Nov. 25, 2003

Related U.S. Application Data

(60) Provisional application No. 60/319,959, filed on Feb. 20, 2003.

(51) Int. Cl.
*F42B 39/00* (2006.01)

(52) U.S. Cl. ..... 206/3; 206/1.51; 206/315.11; 206/317; 206/586; 206/521; 206/446; 206/523

(58) Field of Classification Search ..... 206/3, 206/317, 1.5, 446, 315.11, 586, 521, 523; 42/87

See application file for complete search history.

(56) References Cited

U.S. PATENT DOCUMENTS 1,346,636 A * 7/1920 Cottle ..... 206/1.5
2,052,491 A * 8/1936 Rueppel ..... 206/3
3,486,451 A * 12/1969 Moore et al. ..... 102/517
3,811,216 A * 5/1974 Sauey et al. ..... 43/26
3,939,967 A * 2/1976 Tenney et al. ..... 206/3
4,159,764 A * 7/1979 Schinke ..... 206/3
4,643,302 A * 2/1987 Baumgardner ..... 206/315.1
4,733,773 A * 3/1988 LaBianca et al. ..... 206/3
4,762,222 A * 8/1988 Martin ..... 206/3
5,005,743 A * 4/1991 Ramsay ..... 224/601
5,176,465 A * 1/1993 Holsted ..... 403/379.6
5,779,031 A * 7/1998 Moraine et al. ..... 206/3
6,472,070 B1 * 10/2002 Muraoka et al. ..... 428/418
6,772,877 B1 * 8/2004 Lam et al. ..... 206/3

* cited by examiner

*Primary Examiner*—Mickey Yu
*Assistant Examiner*—Steven Pollicoff
(74) *Attorney, Agent, or Firm*—Michael C. Sachs; John F. Moran

(57) ABSTRACT

A packaging system for a single ammunition includes a cylindrical metal container and a cap therefore. A locking mechanism locks the cap to the top end of the container and a guiding mechanism guides the cap onto the top end of the container before the locking mechanism is locked to assure proper alignment. A plurality of impact rings are located laterally about the container and the cap to provide impact protection therefore. A stacking mechanism for each container allows a plurality of the containers to be securely stacked adjacent one another. The stacking mechanism includes a first top member and a second top member located adjacent the top ring and located 180° from one another about the cap such that the first top member of one cap interlocks with the second top member of an adjacent cap, and a similar arrangement on the bottom ring of the container.

14 Claims, 2 Drawing Sheets

PACKAGING SYSTEM FOR AMMUNITION

CROSS REFERENCE TO RELATED APPLICATIONS

This application claims benefit under 35 USC 119(e) of provisional application 60/319,959, filed Feb. 20, 2003, the entire file wrapper contents of which provisional application are herein incorporated by reference as though fully set forth at length.

FEDERAL RESEARCH STATEMENT

The inventions described herein may be manufactured, used and licensed by or for the U.S. Government for U.S. Government purposes.

BACKGROUND OF INVENTION

The present packaging system for 120 mm mortar tactical rounds consists of two fiber tubes in an overpacked metal container. In order to unpack the rounds, the user has to unpalletize the metal container, remove the fiber tubes and load the fiber tubes in a mortar carrier rack. The total weight of the packaging materials is 35 lb., with the metal container weighing 23 lb. and each fiber tube weighing 6 lb. Thus, the current packaging system requires two people to carry it even a short distance. This current packaging system is thus very heavy, bulky and has three layers, so that it is undesirable in terms of weight and ease of handling.

SUMMARY OF INVENTION

In accordance with the present invention, a packaging system for a single ammunition is provided which includes a generally cylindrical container made of metal having an open top end and a closed bottom end. A cap closes and seals the top end of the container, and a locking mechanism locks the cap to the top end of the container. A guiding mechanism is used to guide the cap onto the top end of the container before the locking mechanism is locked so that the locking mechanism is properly aligned for locking. A plurality of impact rings are located about the container and the cap. These rings extends laterally beyond the container and the cap to provide impact protection for the container and the cap. The plurality of rings include a container bottom ring adjacent the bottom end of the container and a cap top ring adjacent the cap. A stacking mechanism is also provided on each container whereby a plurality of the containers are securely stacked adjacent one another. This stacking mechanism includes (a) a first top member and a second top member located adjacent the top ring of the cap and located 180° from one another about the cap such that the first top member of one cap interlocks with the second top member of an adjacent cap, and (b) a first bottom member and a second bottom member located adjacent the bottom end of the container and located 180° from one another about the container such that the first bottom member of one the container interlocks with the second bottom member of an adjacent the container.

In a preferred embodiment, the packaging system further includes a handle attached to the cylindrical container which fits laterally within a longitudinal profile of the impact rings, and a removable and adjustable shoulder strap which attaches to the container bottom ring and the cap top ring. In addition, a coating of fire-retardant paint is provided on the cylindrical container and the cap.

In the preferred embodiment, the first top member and the first bottom member include male segments, and the second top member and the second bottom member include female segments in which associated male segments are received to interlock adjacent containers. More preferably, the male segments are plugs which extend laterally from the cap top ring and the container bottom ring respectively, and the female segments are lateral holes in the cap top ring and the container bottom ring respectively in which associated plugs are received to interlock adjacent containers.

Also in the preferred embodiment, there are at least four of the impact rings, which are rounded octagonal shaped rings. In addition, the cap top ring extends longitudinally to a longitudinal end of the cap to help protect the cap longitudinally, and the container bottom ring extends longitudinally to a longitudinal end of the bottom end of the container to help protect the bottom end longitudinally.

Further in the preferred embodiment, the locking mechanism includes a tamper evident member. In addition, the locking mechanism pulls the cap longitudinally into the guiding mechanism during an initial locking movement of the locking mechanism.

It is an advantage of the present invention that the packaging system for a 120 mm mortar round can be carried by a single person.

It is also an advantage of the present invention that a handle and/or a shoulder strap is provided to make it easier to carry the packaging system for short distances.

It is a further advantage of the present invention that the packaging system provides environmental protection equal to or better than the present packaging system.

It is yet another advantage of the present invention that the reduced weight thereof allows for an increase in the number of rounds which can be carried by each standard pallet.

It is still another advantage of the present invention that it provides a stable side-by-side set up.

Other features and advantages of the present invention are stated in or apparent from detailed descriptions of presently preferred embodiments of the invention found hereinbelow.

DETAILED DESCRIPTION

Figure 1:
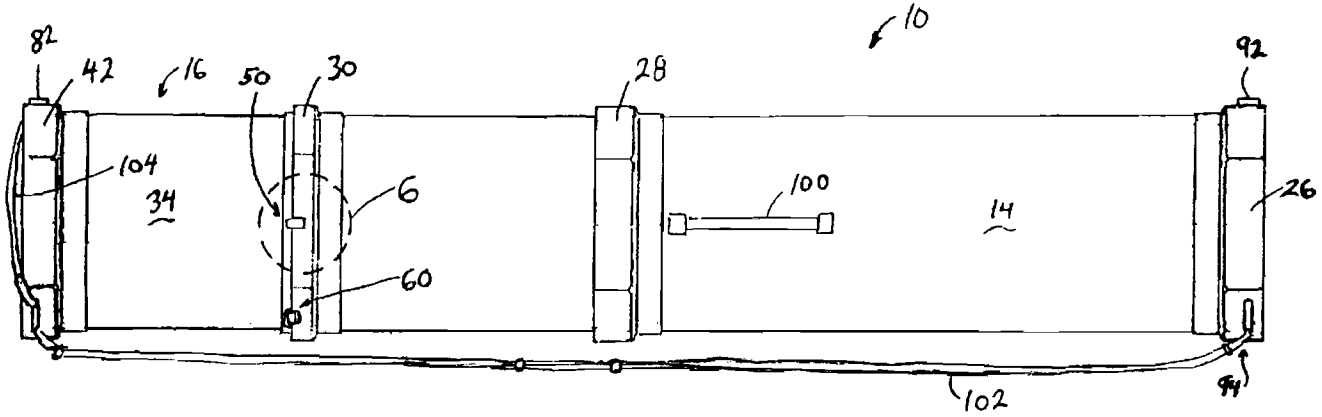
FIG. 1 is an elevation view of a packaging system for ammunition in accordance with the present invention.
Figure 2:
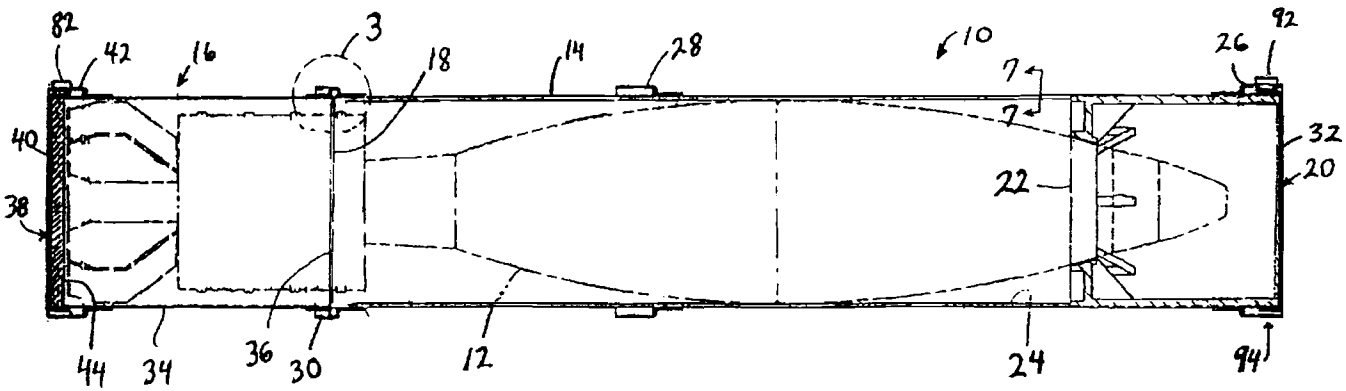
FIG. 2 is a cross-sectional view of the packaging system depicted in FIG. 1.

With reference now to the drawings in which like numerals represent like elements throughout the views, a packaging system 10 for a single ammunition 12 (shown only in a chained line in FIG. 2) such as a 120 mm mortar tactical round is depicted in FIGS. 1 and 2. Packaging system broadly includes two parts, a generally cylindrical container 14 and a cap 16 therefore both of which are preferably made of a suitable strong and weldable metal. The overall weight of packaging system 10, where packaging system is about 30 inches long and 5.4 inches wide, is about 9 pounds.

Figure 7:
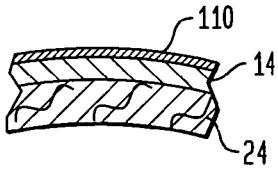
FIG. 7 is an enlarged cross-sectional view of the portion of the container taken along section line 7—7 in FIG. 2.

Container 14 includes an open top end 18 and a closed bottom end 20. It will be appreciated that ammunition 12 is securely loaded in container 14 as known in the art by use of a nose support 22 which keeps the nose of ammunition 12 spaced from closed bottom end 20. In addition, a corrugated liner 24 as best shown in FIG. 7 is also used to keep ammunition 12 spaced from the side wall of container 14.

Suitably welded to container 14 are a plurality of impact rings, namely a bottom ring 26, a middle ring 28 and upper ring 30. Rings 26, 28 and 30 are preferably rounded octagonal shaped as shown best by upper ring 30 in FIG. 4. As shown in FIGS. 1 and 2, rings 26, 28 and 30 each extend laterally beyond container 14 to provide impact protection for container 14 (and more importantly for ammunition 12). As particularly shown in FIG. 2, bottom ring 26 extends longitudinally to the longitudinal end of container 14 formed by end plate 32 welded thereat. Rings 26, 28, and 30 are formed from steel and are designed to absorb any impact during accidental drops of packaging system 10 or the like and thus to protect ammunition 12 from being damaged. The octagonal shape of rings 26, 28 and 30 increases the surface area of impact, and thus serves to reduce the overall shock of an impact. Obviously, bottom ring 26 is the more likely to be impacted during an accidental drop, as it protects packaging system 10 both laterally (together with rings 28 and 30) as well as longitudinally at closed bottom end 20.

Cap 16 closes and seals the open top end 18 of container 14, and in this preferred embodiment cap 16 includes a cylindrical section 34. Cylindrical section 34 matches container 14, and cylindrical section 34 includes an open bottom end 36 and a closed top end 38. Top end 38 is closed by an end plate 40 welded thereat. Located at closed top end 38 is a cap top ring 42. Top ring 42 also serves as an impact ring just like bottom ring 26, and thus top ring 42 is essentially identical to bottom ring 26 but reversed in longitudinal direction to extend longitudinally to the longitudinal end of cap 16 formed by end plate 40. Located interiorly of end plate 42 is an end liner 44 which prevents the tail end of ammunition 12 from contacting end plate 40 directly.

Figure 6:
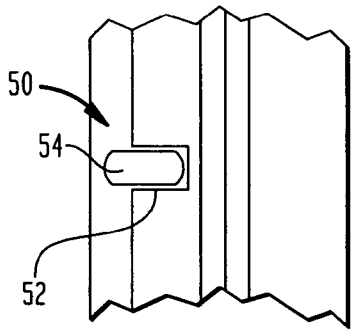
FIG. 6 is an enlarged view of the portion of the guiding system circled in FIG. 1 and identified with the number 6.

In order to properly align open bottom end 36 of cap 16 with open top end 18 of container 14 when closing packaging system 10, a guiding mechanism 50 is provided as best shown in FIG. 6. Guiding mechanism 50 in this preferred embodiment is a pair of top opening notches 52 (only one of which is shown, the other being located 180° therefrom) provided in upper ring 30 and a suitably positioned mating pair of plugs 54 extending laterally from bottom end 36 of cap 16 which are received in respective notches 52 when cap 16 is properly positioned on container 14. The use of guiding mechanism 50 provides for an easy and quick assembly of cap 16 to container 14 with no positioning error.

Figure 4:
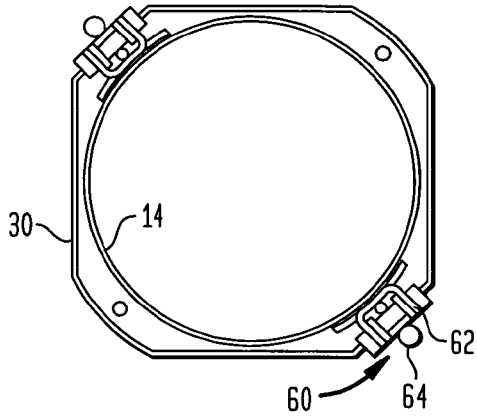
FIG. 4 is a top end view of the upper impact ring as shown in FIG. 1.

In order to lock cap 16 onto container 14, a locking mechanism 60 is used. Locking mechanism 60 is preferably a toggle latch 62 or the like well known in the art, which is further preferably an over-center type so that once latch 62 is closed latch 62 is biased to stay in the closed position. Toggle latch 62 is substantially contained within the profile of upper ring 30 as shown in FIG. 4 so that stacking of a plurality of adjacent packaging systems 10 can be easily effected (as discussed in detail subsequently). While not shown in detail due to the notoriously old nature of such toggle latches, it will be appreciated that latch 62 includes a lever portion having a movable V (or U) shaped claw, which lever portion is attached to upper ring 30, and a hook is provided on cylindrical section 34 of cap 16 which the claw engages or hooks on.

Conveniently, as shown in FIG. 4, latch 62 also includes a tamper evident member 64 such that after an initial locking of toggle latch 62 it will be evident if toggle latch 62 has been opened and hence if cap 16 has been previously removed. As is well known in the art, tamper evident member 64 is typically a looped wire which is suitably sealed after passing through some hole portion of latch 62. It will also be appreciated that the use of toggle latch 62 causes cap 16 to be pulled longitudinally to effect the guiding function of guiding mechanism 50 during an initial locking of latch 62 so long as notches 52 and plugs 54 are more or less aligned, but if not aligned toggle latch 62 can not close.

Figure 3:
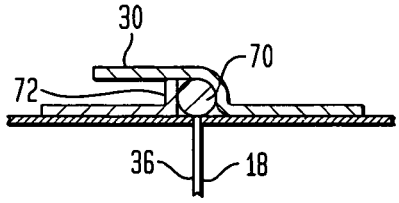
FIG. 3 is an enlarged view of the portion of the packaging system circled in FIG. 2 and identified with the number 3.

Except for the joint between cap 16 and container 14, cap 16 and container 14 also protect ammunition 12 from the environment as container 14 and cap 16 are otherwise air water impervious. Thus, in order to completely seal packaging system 10 against air, water and the like, a seal 70 as best shown in FIG. 3 is provided between open top end 18 of container 14 and open bottom end 36 of cap 16. Seal 70 is preferably neoprene or the like, and seal 70 is adhesively attached to upper ring 30 by an adhesive (not shown) located between seal 70 and the small portion of container 14 extending up inside of upper ring 30 as shown in FIGS. 3 and 4. Mounted adjacent open bottom end of cap 16 as by welding is a flange 72, so that flange 72 compresses seal 70 to effect the seal when toggle latch 62 is closed to secure cap 16 to container 14.

Figure 5:
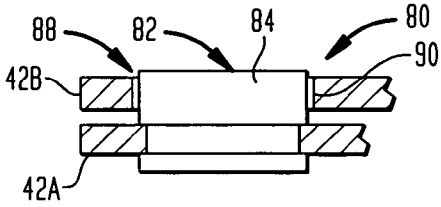
FIG. 5 is a cross-sectional view of an interlocking of two packaging systems in accordance with the present invention.

Packaging system 10 also includes a stacking mechanism 80 so that a plurality of packaging systems 10 can be securely or stably stacked adjacent one another (side-by-side) in a suitably sized pallet or the like, and this stability exists during the palletization process as well and makes transport easier. Thus, another reason that impact rings 26, 28, 30 and 42 are identically octagonal shaped and symmetrically positioned is to allow and to promote such a stacking ability of systems 10. In addition, to better secure each system 10 in the stacked position, stacking mechanism 80 includes a first top member 82. It will be appreciated that in FIG. 5 exemplary portions of two top rings 42A and 42B of two adjacent packaging systems 10 are shown to illustrate stacking mechanism 80. Preferably, first top member 82 includes a male segment extending laterally away from top ring 42A, and in this preferred embodiment first top member 82 is a simple polyethylene plug 84 or the like. Conveniently, plug 84 is shaped to be resiliently positioned and then trapped in an aperture provided in top ring 42A as shown in FIG. 5. Provided 180° around from first top member 82 is a second top member 88, which in FIG. 5 is depicted on an adjacent top ring 42B. Preferably, second top member 88 includes a female segment extending laterally towards top ring 42B for receipt of the male segment of top ring 42A, and in this preferred embodiment second top member 88 is a simple lateral hole 90 in top ring 42B sized to receive a portion of plug 84 extending from top ring 42A as shown.

Similarly, stacking mechanism 80 includes a first bottom member 92 and a second bottom member 94 located in bottom ring 26. As members 92 and 94 are otherwise identical to members 82 and 88 in form and function, members 92 and 94 will not be further discussed. By use of stacking mechanism 80, each packaging system 10 within a stack is thus interconnected with two adjacent packaging systems in order to provide a relatively secure stack of packaging systems 10.

As packaging system 10 is designed for only a single ammunition 12, which while quite heavy can be carried for short distances by a user, packaging system 10 also includes a handle 100 attached to container 14 near the mid-weight point of loaded packaging system 10. Handle 100 is preferably a simple hand strap or the like in order to fit within the profile of rings 26, 28, 30 and 42 and thus not to interfere with the stacking of packaging systems 10 as described above. In addition, packaging system 10 also includes an adjustable shoulder strap 102 which is clipped or otherwise releasably attached to bottom ring 26 and top ring 42 of packaging system 10 (as well known in the art). Shoulder strap 102 is intended to be used in place of handle 100 at the user's preference. As shoulder strap 102 does not fit within the profile of rings 26, 28, 30 and 42, shoulder strap 102 is provided separately and attached to rings 26 and 42 as/when needed.

As an aid to removing cap 16 from container 14 when packing or unpacking is desired, a removable cap handle 104 can be provided which is similarly attached to cap 16 (on both sides) as shoulder strap 102 is attached.

In order to better protect ammunition 12, packaging system 10 also includes a fire-retardant coating 110 as shown schematically in FIG. 7. Coating 110 is applied all over container 14 and cap 16 and serves to reduce the spreading of any flame and to enhance resistance to unplanned stimuli.

While packaging system 10 has been depicted with four impact rings, it will be appreciated that a minimum of three impact rings could be used or more than four impact rings could be used as desired and for particular applications (such as shorter or longer packaging systems, and/or lighter or heavier ammunition).

Thus, while the present invention has been described with respect to exemplary embodiments thereof, it will be understood by those of ordinary skill in the art that other variations and modifications can be effected within the scope and spirit of the invention.

The invention claimed is:

1. A packaging system for a single ammunition, comprising:

a generally cylindrical container which is made of metal, said container including an open top end and a closed bottom end;

a cap which closes and seals said top end of said container;

a locking mechanism which locks said cap to the top end of said container, wherein the locking mechanism is biased to stay in a closed position;

a guiding mechanism that includes a plug and a notch, and that guides said cap onto said top end of said container before said locking mechanism is locked so that said locking mechanism is properly aligned for locking;

a plurality of impact rings located about said container and said cap, said rings extending laterally beyond said container and said cap to provide impact protection for said container and said cap;

said plurality of rings including a container bottom ring adjacent the bottom end of said container, a cap top ring adjacent to the top end of said cap and a ring at the top of the container; and a stacking mechanism comprising plugs and lateral holes wherein a plurality of said containers are securely stacked adjacent one another, said stacking mechanism including a first top member and a second top member located adjacent said cap top ring of said cap and located 180° from one another about said cap such that said first top member of one said cap interlocks with the second top member of an adjacent said cap, by means of a portion of a plug in a lateral hole; and a first bottom member and a second bottom member located adjacent said bottom end of said container and located 180° from one another about said container such that said first bottom member of one said container interlocks with the second bottom member of an adjacent said container by means of the portion of the plug in the lateral hole.

2. A packaging system for a single ammunition as claimed in claim 1, further including:

a handle attached to said cylindrical container which fits laterally within a longitudinal profile of said impact rings; and a removable and adjustable shoulder strap which attaches to said container bottom ring and said cap top ring.

3. A packaging system for a single ammunition as claimed in claim 1, and further a coating of fire-retardant paint provided on said cylindrical container and said cap.

4. A packaging system for a single ammunition as claimed in claim 1, wherein there are at least four of said impact rings.

5. A packaging system for a single ammunition as claimed in claim 1, wherein said impact rings are rounded octagonal shaped rings.

6. A packaging system for a single ammunition as claimed in claim 1:

wherein said cap top ring extends longitudinally to a longitudinal end of said cap to help protect said cap longitudinally; and wherein said container bottom ring extends longitudinally to a longitudinal end of said bottom end of said container to help protect said bottom end longitudinally.

7. A packaging system for a single ammunition as claimed in claim 1, wherein said locking mechanism includes a tamper evident member.

8. A packaging system for a single ammunition as claimed in claim 1, wherein said locking mechanism pulls said cap longitudinally into said guiding mechanism during an initial locking movement of said locking mechanism.

9. A packaging system for a single ammunition as claimed in claim 3:

wherein said cap top ring extends longitudinally to a longitudinal end of said cap to help protect said cap longitudinally; and wherein said container bottom ring extends longitudinally to a longitudinal end of said bottom end of said container to help protect said bottom end longitudinally.

10. A packaging system for a single ammunition as claimed in claim 9, wherein said locking mechanism includes a tamper evident member.

11. A packaging system for a single ammunition as claimed in claim 10, wherein said locking mechanism pulls said cap longitudinally into said guiding mechanism during an initial locking movement of said locking mechanism.

12. A packaging system for a single ammunition as claimed in claim 11, further including:

a handle attached to said cylindrical container which fits laterally within a longitudinal profile of said impact rings; and a removable and adjustable shoulder strap which attaches to said container bottom ring and said cap top ring.

13. A packaging system for a single ammunition as claimed in claim 12, wherein there are at least four of said impact rings.

14. A packaging system for a single ammunition as claimed in claim 13, wherein said impact rings are rounded octagonal shaped rings.

* * * * *